US005845566A

United States Patent [19]

Lee

[11] Patent Number: 5,845,566

[45] Date of Patent: Dec. 8, 1998

[54] MULTI-SLOT CLOSED TYPE POWERFUL GARBAGE COMPRESSION STRUCTURE

[76] Inventor: Ming-Fong Lee, 2F, No. 21, Sec. 3, Yen Pin N. Rd., Taipei, Taiwan

[21] Appl. No.: 69,950

[22] Filed: Apr. 30, 1998

[51] Int. Cl.[6] ..... B30B 3/00

[52] U.S. Cl. ..... 100/73; 100/131; 100/137; 100/145; 100/177; 414/287; 414/293; 414/468

[58] Field of Search ..... 100/73, 74, 131, 100/137–140, 144–146, 177; 414/287, 293, 296, 468, 502, 526

[56] References Cited

U.S. PATENT DOCUMENTS

| | | | |
|---|---|---|---|
| 2,164,164 | 6/1939 | Price | 100/137 |
| 2,469,033 | 5/1949 | Dear | 414/468 |
| 2,543,571 | 2/1951 | Ferrari | 100/145 |
| 2,594,054 | 4/1952 | McNamara et al. | 100/131 |
| 2,690,270 | 9/1954 | Tilch et al. | 414/468 |
| 2,704,161 | 3/1955 | Ogden | 414/526 |
| 2,825,478 | 3/1958 | Hunnicutt et al. | 414/468 |
| 2,991,947 | 7/1961 | Schuyler | 414/526 |
| 3,481,268 | 12/1969 | Price et al. | 100/74 |
| 4,211,164 | 7/1980 | Fichtl et al. | 100/145 |
| 4,257,728 | 3/1981 | Schmidt et al. | 414/468 |
| 4,872,404 | 10/1989 | Quetsch et al. | 100/177 |

FOREIGN PATENT DOCUMENTS

| | | | |
|---|---|---|---|
| 0093825 | 11/1983 | European Pat. Off. | 100/144 |
| 517957 | 3/1955 | Italy | 100/145 |
| 3-111302 | 5/1991 | Japan | 100/177 |

*Primary Examiner*—Stephen F. Gerrity
*Attorney, Agent, or Firm*—Donald C. Casey, Esq.

[57] ABSTRACT

A multi-slot closed type powerful garbage compression structure including a housing, an inner cylinder internally provided with guide plates and being inclined forwardly, and a push bar behind the inner cylinder. The housing is provided with four slots at a rear section adapted to receive garbage, and a garbage outlet at a front end, the outlet being provided with a slide plate, and a waste water receiving trough at a bottom side. When garbage is dumped into the housing via the slots, the push bar rotates to push the garbage into the inner cylinder which rotates to compress the garbage. When the garbage inside the inner cylinder is full, the push bar may prevent reverse flow of the garbage. By the use of both the push bar and the guide plates inside the inner cylinder, better compression effects are achievable to reduce garbage storage space and eliminate use of hydraulic cylinders and thrust devices.

1 Claim, 4 Drawing Sheets

MULTI-SLOT CLOSED TYPE POWERFUL GARBAGE COMPRESSION STRUCTURE

BACKGROUND OF THE INVENTION (a) Field of the Invention

The present invention relates to a garbage compression structure, and more particularly to a multi-slot closed type powerful garbage compression structure.

(b) Description of the Prior Art

Landfills are hardly available today, and construction of incinerators is often protested by residents in the neighborhood. The concentration of population in cities aggravates the problem of waste and garbage disposal, and the collection and storage of waste and garbage become increasingly important.

There is a kind of garbage storage device available, which makes uses of guide plates to compress the garbage. But as the types of garbage are many and some of them are bulky, such as PE bottles and paper cartons, the storage capacity is discounted. A kind of storage device with cutters is then developed. The cutters cut the garbage into pieces so that its size is reduced and a higher storage capacity is obtainable. In such a device, the garbage is sent to a cutter unit before being pushed to the storage tank. The cut garbage is then discharged and collected by the truck. More garbage is dumped and cut until saturated. The problems with such a device are:

1. The cutter unit cannot effectively handle larger or harder objects and the blades may be damaged as a result. Frequent replacement of the blades is necessary. The economical efficiency is therefore poor.
2. The storage tank utilizes only guide plates in an inner cylinder to compress the garbage and relies upon the cutter unit to reduce the size of garbage. Such a structure is not reliable and the maintenance cost is extremely high. For small communities and independent buildings, the cost is excessively high. Besides, frequent trouble shooting is required. It is therefore impractical.

There is another kind of storage tank that utilizes a compression device including a hydraulic cylinder and a thrust device. Garbage is dumped in batches in a tank to be subjected to compression by the hydraulic cylinder and thrust device until saturated, so as to increase the storage capacity.

However, there are the following drawbacks:

1. The hydraulic tank and thrust device are large-size structures which occupy much space and require maintenance by professionals. Besides, they generate much noise during operation. Such a structure is therefore not suitable for use in ordinary communities, building, schools, etc.
2. There is only a single feed slot, which is very inconvenient.
3. As the mechanical structure is complicated and is all the time exposed to garbage and dirty water, it is prone to malfunctioning, and maintenance is time consuming and costly.

SUMMARY OF THE INVENTION

A primary object of the present invention is to provide a multi-slot closed type powerful garbage compression structure, which includes a housing, a rotary inner cylinder in an inclined position and internally provided with guide plates that increase in height towards a front end of the inner cylinder, and a push bar equipped with propellers behind the inner cylinder inside the housing. The housing has four slots at one side and a garbage outlet at the other side. The outlet is provided with a slide plate. A waste water receiving trough is further provided at a bottom side of the housing. When garbage is dumped into the housing via the slots, the push bar rotates to push the garbage into the inner cylinder, which rotates to compress the garbage, the latter being pushed forwardly along the inclination of the inner cylinder. When the garbage is being compressed, it is prevented from reverse flow by the push bar that exerts a reverse thrust. Better compression effects are therefore achievable. Besides, garbage storage space can be saved.

Another object of the present invention is to provide a multi-slot closed type powerful garbage compression structure, in which the housing is provided with slots at the back, the left and right sides, and the top to accelerate collection rate. The top slot may be connected via a duct to the upper floors to facilitate users at the upper floors.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

The present invention essentially comprises a housing 10, a push bar, and an inner cylinder.

Figure 1:
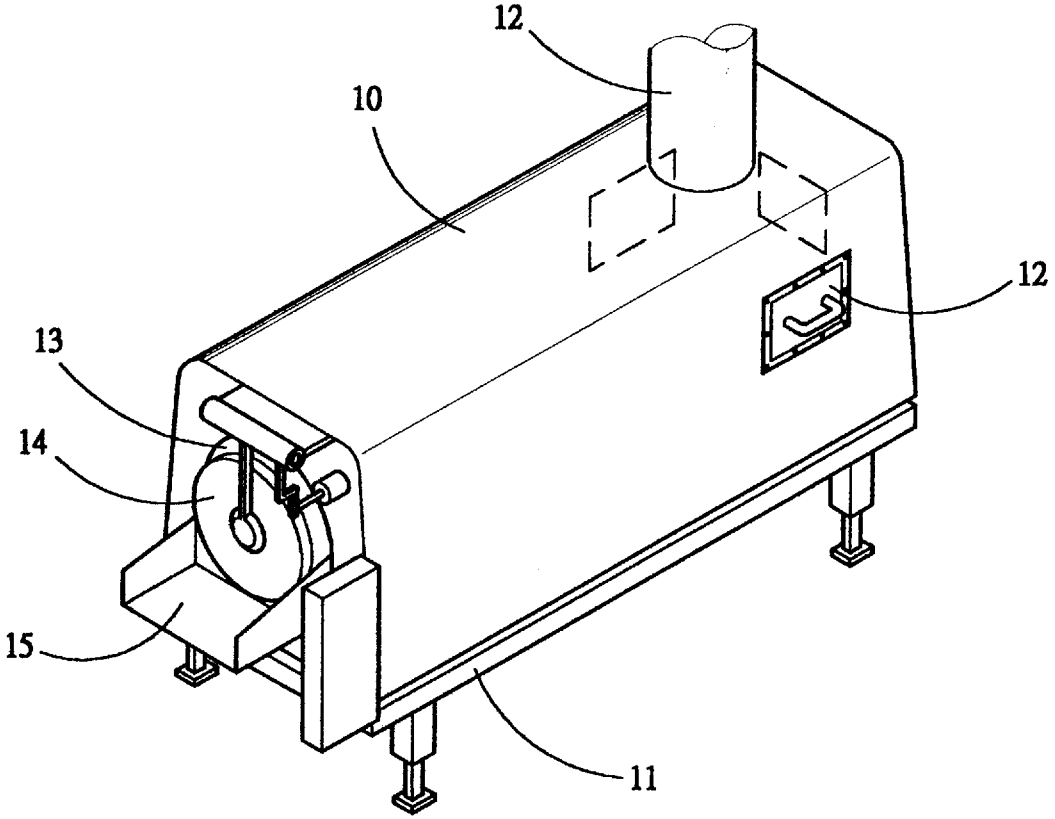
FIG. 1 is a schematic elevation of the present invention.

The housing 10 is substantially an elongate cylindrical structure including legs 11 at a lower side, and slots 12 at a rear section thereof at the back, the left and the right sides, as well as at the top for receiving garbage, in which the slots 12 at the back and the sides must be higher than the push bar 20 in order to avoid possible danger. The slot 12 at the top may be connected to the upper floors by a duct. The front end of the housing 10 is provided with an opening 13 and a lid 14 openable with respect to the opening. The opening 13 is provided with a slide plate 15 at its front end, which will cause the garbage to slide down therefrom when the lid 14 is opened for collection. Furthermore, a waste water receiving trough 16 is provided at a bottom side of the housing 10 to communicate with the interior of the housing 10. Waste water generated during compression of the garbage is conducted to the trough 16 for discharge, as shown in FIG. 1.

The push bar 20 is disposed inside the housing 10 and is a substantially straight bar provided with continuous propellers 21 for pushing the dumped garbage into the inner cylinder 30 in a spiral fashion. An antiseptic spraying device 22 is mounted above the push bar 20 within the housing 10 at a suitable position.

Figure 2:
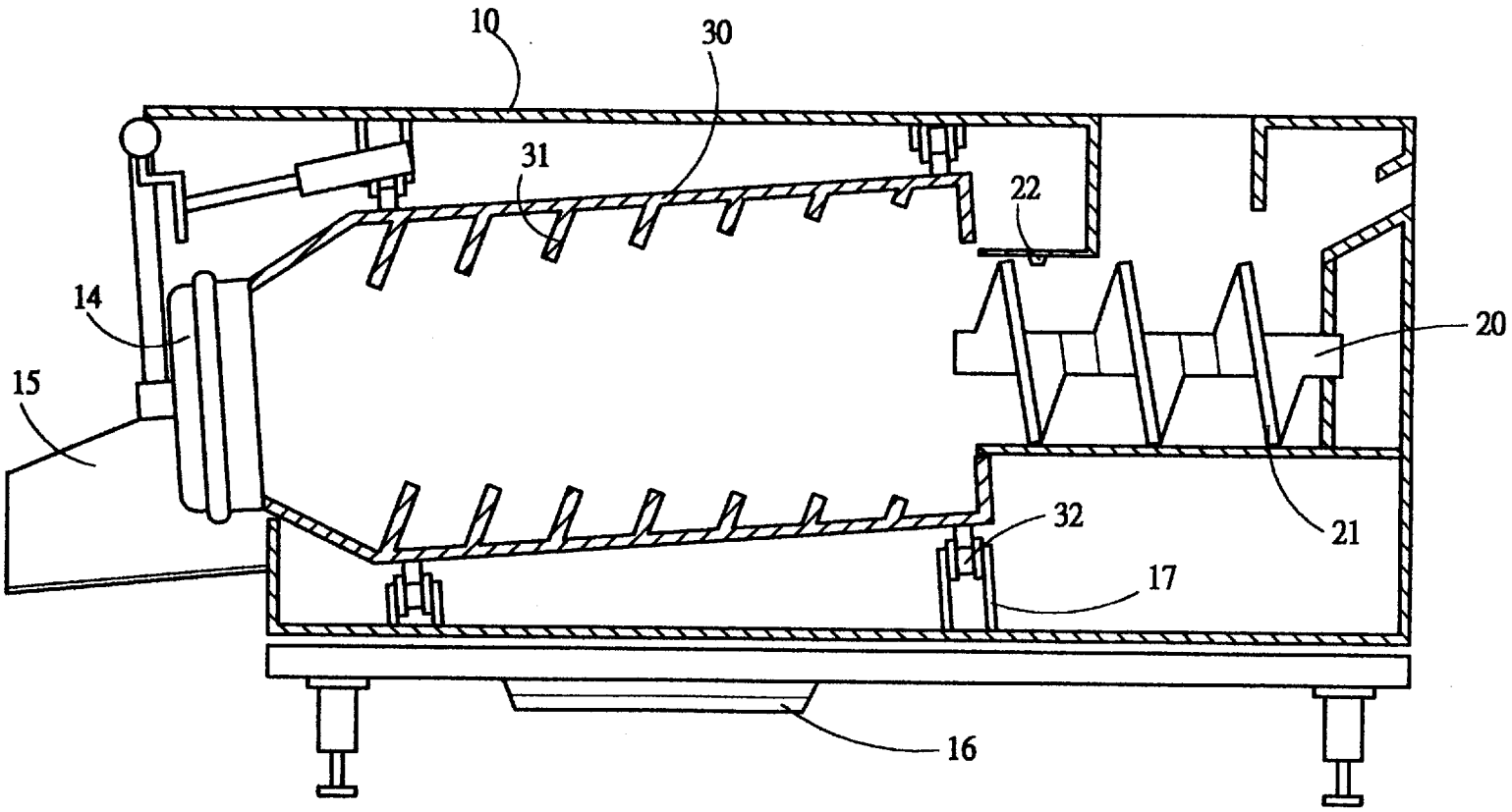
FIG. 2 is a schematic view illustrating the internal structure of the present invention.

The inner cylinder 30 is a cylindrical structure dipping towards the front end of the housing 10, the angle of inclining being about 5°. The interior of the inner cylinder 30 is provided with guide plates 31 that gradually increase in depth towards the front end of the housing 10. They may generate a compression effect during rotation. The outer side of the inner cylinder 30 at the corners are disposed rollers 32 insertably provided in limiting recessed rings 17 at their inner sides respectively to thereby ensure that the inner cylinder 30 will not deviate or deflect during rotation, as shown in FIG. 2.

There are further provided a drive motor and transmission device adapted to drive the inner cylinder 30 and push bar 20. However, as they are well known in the art, they will not be discussed in detail herein.

Figure 3:
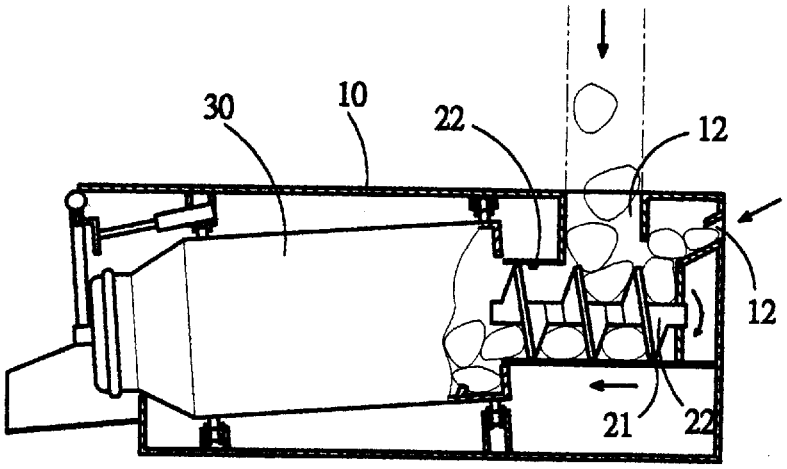
FIGS. 3A, 3B, and 3C are respective schematic views illustrating operation of the present invention.
Figure 3:
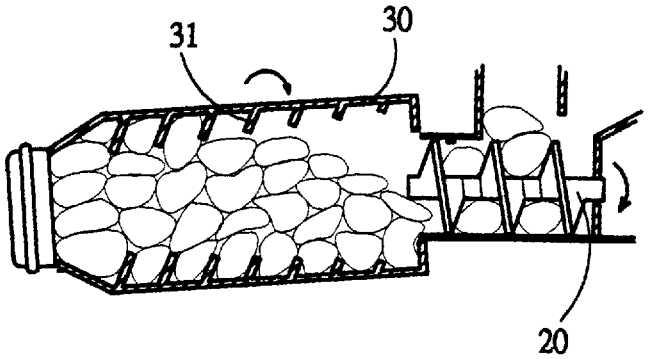
Figure 3:
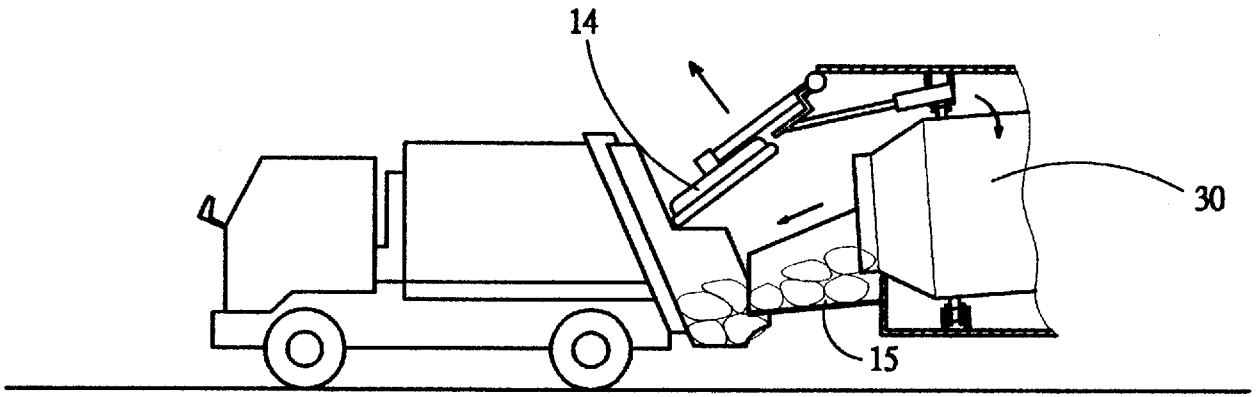

The operation of the present invention is described in detail hereinafter. Garbage is dumped via the slots 12 into the interior of the housing 10. As slots 12 are provided at the rear, the sides and the top of the housing 10, garbage collection efficiency is sped up. The garbage will fall in the position of the push bar 20 and is then rotated thereby. The propellers 21 advance the garbage forward into the inner cylinder 30, while the antiseptic spraying device 22 above operates to sprinkle antiseptic on the garbage to remove bad odor and kill germs. The inner cylinder 30 then rotates to advance the garbage further forwardly, as shown in FIG. 3A. The garbage follows the inclination of the inner cylinder 30 while moving forwardly, while the push bar 20 continues to bring in more collected garbage until the inner cylinder 30 is fully loaded and starts to compress the garbage. The push bar 20 may then send in more garbage and the inner cylinder 30 continues rotation and compression, as shown in FIG. 3B, until no more garbage can be handled. Since the inner cylinder 30 is configured to slant forwardly, and the guide plates 31 increase in height towards the front as well, better compression effects during rotation may be generated. A compression rate of 1:4 may be achievable. Besides, when the push bar 20 presses within the inner cylinder 30, it may provide a reverse baffling function to prevent reverse flow of garbage. In addition, the waste water generated during the process of compression is collected in the trough 16 and discharged separately. When the housing 10 is saturated with garbage, a light indicator will be "on" to inform clean-up personnel. At this point, the lid 14 may be opened and starts the inner cylinder 30, which begins rotating to discharge the garbage inside. The garbage then slides down via the slide plate 15 into the collect truck, as shown in FIG. 3C, which further compresses the garbage. After removal of the garbage, the lid 14 is closed and the housing 10 is ready to collect garbage.

In summary, the present invention provides a multi-slot closed type powerful garbage compression structure, which has an inner cylinder capable of spiral compression and a push bar with propellers to drastically improve the efficiency of garbage collection and storage, effectively solving the drawbacks with the prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. A multi-slot closed type powerful garbage compression structure, comprising:

a housing, having legs at a bottom side, and slots at a rear section thereof at the back, the left and right sides, and the top, adapted to receive garbage, the slot at the top being connected via a duct to upper floors, said housing further having an outlet and a liftable lid at a front end thereof, said outlet being provided with a slide plate at a front end thereof, said housing being further provided with a waste water receiving trough at the bottom side communicating with the interior of said housing;

a push bar, being substantially a straight bar structure located at a rear end of an inner cylinder in the interior of said housing, said push bar being provided with continuous propellers adapted to rotate to thereby generate powerful compression effects when more garbage is dumped into said housing when said inner cylinder is full, and an antiseptic spraying device located above said push bar at a suitable position; and said inner cylinder, being configured to slant forwardly and internally provided with guide plates that increase gradually in height towards a front end of said inner cylinder, said guide plates generating a powerful compression effect during rotation, said inner cylinder being further provided with rollers at corners of the outer side thereof, said rollers being insertably disposed in limiting recessed rings at the inner side of said housing to ensure that said inner cylinder will not deflect during rotation;

drive motor means; and transmission means, wherein said slots located at the back, the left and right sides, and the top of said housing accelerates the rate of garbage collection, and said inner cylinder having a slanting angle and said guide plates that increase in height gradually cooperates with said push bar to achieve powerful compression effects.

* * * * *